US006318341B1

(12) United States Patent
Gmelin et al.

(10) Patent No.: US 6,318,341 B1
(45) Date of Patent: Nov. 20, 2001

(54) FUEL INJECTION SYSTEM

(75) Inventors: Karl Gmelin, Flein; Jochen Staiger, Gerlingen; Andreas Bretschneider, Illingen; Thomas Fuerst, Schwieberdingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,536

(22) PCT Filed: Jul. 29, 1999

(86) PCT No.: PCT/DE99/02329

§ 371 Date: Nov. 1, 2000

§ 102(e) Date: Nov. 1, 2000

(87) PCT Pub. No.: WO00/29743

PCT Pub. Date: May 25, 2000

(30) Foreign Application Priority Data

Nov. 18, 1998 (DE) ..... 198 53 090

(51) Int. Cl.[7] ..... F02M 33/02
(52) U.S. Cl. ..... 123/470; 123/456
(58) Field of Search ..... 123/456, 468, 123/469, 470

(56) References Cited

U.S. PATENT DOCUMENTS

| | | | |
|---|---|---|---|
| 4,205,789 | 6/1980 | Raufeisen . | |
| 4,982,983 | 1/1991 | Lenzi . | |
| 5,806,494 | 9/1998 | Glassey . | |
| 6,073,612 * | 6/2000 | Ohkubo et al. | 123/456 |
| 6,148,797 * | 11/2000 | Gmelin | 123/456 |

FOREIGN PATENT DOCUMENTS

| | | |
|---|---|---|
| 29 08 095 | 9/1980 | (DE) . |
| 42 05 263 | 8/1993 | (DE) . |
| 0 491 582 | 6/1992 | (EP) . |
| 1 431 424 | 5/1966 | (FR) . |
| 08-312503 | 11/1996 | (JP) . |

* cited by examiner

*Primary Examiner*—Thomas N. Moulis
(74) *Attorney, Agent, or Firm*—Kenyon & Kenyon

(57) ABSTRACT

A fuel injection system is used for direct injection of fuel into the combustion chambers of an internal combustion engine. This fuel injection system has at least one fuel injector for each combustion chamber of the internal combustion engine which can be inserted at one spray section into a respective mounting hole provided on a cylinder head of the internal combustion engine and which has a fuel inlet orifice. In addition, there is a fuel distributor line having for each fuel injector a fuel outlet orifice connectable to the fuel inlet orifice of the fuel injector and being attachable to the cylinder head by mounting devices provided for each fuel injector. A hold-down device is provided for each fuel injector for holding down the fuel injector in the respective mounting hole of the cylinder head. Each hold-down device is connected to the respective mounting device. Each mounting, device has a first tightening element for mounting the fuel distributor line on the cylinder head and a second tightening element for applying a hold-down force to the respective fuel injector.

10 Claims, 2 Drawing Sheets

FUEL INJECTION SYSTEM

BACKGROUND INFORMATION

The present invention relates to a fuel injection system for direct injection of fuel into the combustion chamber(s) of an internal combustion engine.

The present invention is based on a fuel injection system. Unexamined Japanese Published Patent Application No. 08-312503 describes mounting holes for one fuel injector, in which each mounting hole may be provided on the cylinder head of an internal combustion engine, with one spray section of the fuel injector inserted into each hole. The fuel injector is held down by a hold-down device designed as a tightening bracket against the relatively high combustion pressure prevailing in the combustion chamber. A fuel distributor line connecting the fuel injectors to a fuel pump supplies fuel to the fuel inlet orifices provided on the fuel injectors. The fuel distributor line has one fuel outlet orifice for each fuel injector. To achieve the required seal, a sealing element in the form of an O-ring is provided for each.

However, one disadvantage of this known assembly method is that each fuel injector must be installed individually on the cylinder head, thus resulting in a very complicated assembly operation involving multiple steps. It is impossible to pretest the fuel injection system for leakage, for example. A fully automatic manufacturing process is made difficult due to the multiple operations.

Furthermore, it is also a disadvantage that the fuel distributor line and the hold-down device of the fuel injectors are mounted in the respective mounting holes in the cylinder head through separate elements. Therefore, the fuel injectors must first be preassembled in the mounting holes before the fuel distributor line can be positioned and attached to the cylinder head. Therefore, this known type of assembly has a relatively low degree of integration and the procedure is complicated.

German Published Patent Application No. 29 08 095 describes a fuel injector not provided for direct injection of fuel can be mounted on a fuel that distributor line by a retaining strap. Also described is an inlet section of the fuel injector that can be inserted into the fuel distributor line by a nipple connector. However, a hold-down force that can withstand the combustion pressure of the internal combustion engine cannot be transmitted over the retaining strap to the fuel injectors, so this type of assembly is unsuitable for fuel injectors for direct injection of fuel into the combustion chamber of an internal combustion engine.

Essentially, it is described in European Published Patent Application No. 0 491,582 that fuel injectors can be preassembled on a fuel distributor line before being inserted into the mounting holes. However, this known fuel injection system is also unsuitable for direct injection of fuel into the combustion chamber of an internal combustion engine, but instead it is suitable for indirect injection of fuel into the intake manifold of the internal combustion engine. The retaining elements are also unsuitable for transmitting an adequate hold-down force for withstanding the combustion pressure of the internal combustion engine, so this type of assembly is also unsuitable for a fuel injection system for direct injection of fuel into the combustion chamber of an internal combustion engine.

SUMMARY OF THE INVENTION

The fuel injection system according to the present invention however, has the advantage that the functions of securing the fuel distributor line and holding down the fuel injectors in the respective mounting holes of the cylinder head are integrated together into the corresponding mounting devices. After mounting the fuel distributor line by tightening the first tightening elements of the mounting devices, a hold-down force which can be predetermined by the second tightening elements can be transmitted to the fuel injectors over the hold-down devices connected to the mounting devices, so the fuel injectors are held down in the mounting holes against the combustion pressure of the internal combustion engine.

Another important advantage is that the fuel injectors can be preassembled on the fuel distributor line together with their hold-down devices, and the fuel injection system can be supplied as a complete system to the manufacturer of the internal combustion engine. The fuel injection system can be pretested for satisfactory functioning, in particular by leakage testing, at the fuel injection system manufacturing plant. Such pretesting ensures that only properly functioning fuel injection systems will be shipped to the internal combustion engine manufacturer, and thus the reliability of the fuel injection system as a whole is improved.

The preassembled fuel injection system can be installed rapidly on the internal combustion engine at the internal combustion engine manufacturing plant without requiring any (great assembly effort, e.g., by a fully automated manufacturing system. This is done by simply inserting the fuel injectors into the mounting holes provided on the cylinder head of the internal combustion engine and attaching the fuel distributor line to the cylinder head by tightening the first tightening elements of the mounting devices. Then a sufficient hold-down force is transmitted to the fuel injectors by tightening the second tightening elements of the mounting device, so that this force can withstand the combustion pressure of the internal combustion engine.

A supporting socket is preferably arranged between a mounting section of the fuel distributor line and the cylinder head, with the first tightening element preferably being designed as a threaded bolt which passes through the mounting section of the fuel distributor line and through the supporting socket and can be screwed into a respective threaded hole in the cylinder head. The hold-down device advantageously has a working section that acts on the respective fuel injector, a mounting section of the fuel distributor line assigned to the supporting socket and a guide section at least partially surrounding the first tightening element as well as a connecting section connecting the working section and the guide section. The second tightening element is advantageously designed as a threaded nut which can be screwed onto a screw head of the first tightening element and acts on the guide section of the hold-down device. This design achieves an integration of the mounting device with the hold-down device.

The hold-down device preferably has a collar that projects radially inward and can be inserted into a groove on the respective fuel injector. This not only permits a hold-down force to be exerted on the respective fuel injector in the direction of the combustion chamber but also allows a force to be exerted in the opposite direction. This is especially advantageous when dismantling the fuel injection system, because the fuel injectors can then be extracted from the mounting holes in the cylinder head with the hold-down device. In addition, when the fuel injection system is preassembled, the fuel injectors are locked on the fuel distributor line by the hold-down devices and the mounting devices and cannot become detached from the preassembled fuel injection system.

A tubular adapter is preferably arranged between each fuel outlet orifice of the fuel distributor line and the respective fuel inlet orifice of the fuel injector. This tubular adapter allows the position and angle to be adjusted within certain limits. Thus, the demands made of the dimensional accuracy of the mounting holes for the fuel injectors on the cylinder head and the dimensional accuracy of the fuel outlet orifices on the fuel distributor line may be less critical.

DETAILED DESCRIPTION

Figure 1:
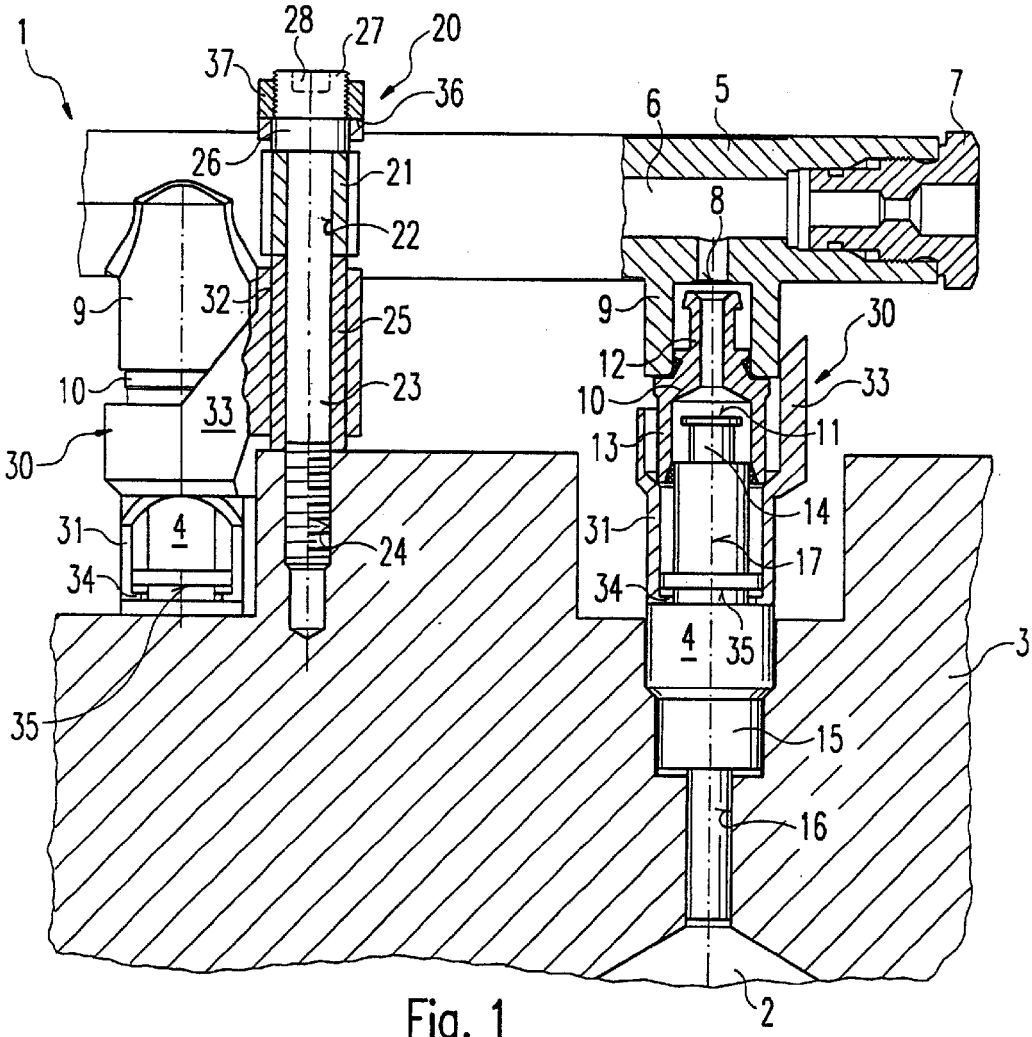
FIG. 1 shows a detail of a longitudinal section through an embodiment of a fuel injection system according to the present invention.

FIG. 1 illustrates a detail of a cross section through an embodiment of the fuel injection system according to the present invention, labeled 1 in general. Fuel injection system 1 is used for direct injection of fuel into the combustion chambers of the internal combustion engine. FIG. 1 indicates a combustion chamber 2 of the internal combustion engine. The combustion chambers of the engine are closed by a cylinder head 3, a detail of which is shown. At least one fuel injector 4 is assigned to each combustion chamber 2 of the internal combustion engine. Fuel injectors 4 are connected to a fuel pump by a fuel distributor line 5.

Fuel distributor line 5, illustrated in a partially cutaway view in FIG. 1, is tubular in shape and has in its interior a fuel channel 6 that can be connected by a connecting flange 7 to a fuel line (not shown). For each fuel injector 4, fuel distributor line 5 has a fuel outlet orifice 8 surrounded by a cup-shaped receptacle 9. In this embodiment, fuel inlet orifices 11 of fuel injectors 4 are connected by a tubular adapter 10 to respective fuel outlet orifice 8 of fuel distributor line 5, so that fuel can flow out of fuel channel 6, through respective fuel outlet orifice 8 and tubular adapter 10 to corresponding fuel inlet orifice 11 of respective fuel injector 4.

Adapter 10 can be inserted into cup-like receptacle 9 of fuel distributor line 5 at a section 12 on the inlet end, and adapter 10 surrounds an inlet section of respective fuel injector 4 at a section 13 on the outlet end. Adapter 10 is sealed by suitable gaskets with respect to receptacle 9 of fuel distributor line 5 and also with respect to inlet section 14 of fuel injector 4. Adapter 10 has the function of compensating for possible deviations in angle and position of fuel injectors 4 with respect to fuel outlet orifices 8 and/or receptacles 9 on fuel distributor line 5.

At a spray section 15, each fuel injector 4 is inserted into a mounting hole 16 designed as a stepped hole in cylinder head 3, so that when fuel injectors 4 are actuated, they inject fuel directly into respective combustion chamber 2 of the internal combustion engine.

Adapter 10 reliably compensates for unavoidable deviations in the position accuracy of mounting holes 16 in cylinder head 3 and receptacles 9 and/or fuel outlet orifices 8 on fuel distributor line 5 due to the manufacturing technology. At the same time, adapter 10 also compensates for deviations in the angles formed by inlet section 14 of fuel injectors 4 to longitudinal axis 17 due to manufacturing inaccuracies within a certain tolerance.

Multiple fuel injectors 4 are arranged at an offset along fuel distributor line 5, with at least one fuel injector 4 being provided for each combustion chamber 2 of the internal combustion engine. As shown better in FIG. 2, which illustrates a detail of the embodiment of the fuel injection system according to the present invention in FIG. 1, a mounting device 20 is provided for each fuel injector 4, so that each fuel distributor line 5 is attached to cylinder head 3. FIG. 1 shows a section along line I—I in FIG. 2. Sectional line I—I is selected so that mounting device 20 is shown in the left portion of FIG. 1, while fuel distributor line 5 and adapter 10 are shown in the right portion of the figure.

Mounting sections 21 which are integrally molded on fuel distributor line 5 are provided for each mounting device 20 or fuel injector 4. Each mounting section 21 has a bore 22 through which passes a first tightening element 23, designed as a threaded bolt in the present embodiment. First tightening elements 23 which are designed as threaded bolts in the present embodiment can each be screwed into a respective threaded hole 24 in cylinder head 3. A supporting socket 25 provided between respective mounting section 21 of fuel distributor line 5 and cylinder head 3 also has a first tightening element 23, designed as a threaded bolt, passing through it when assembled. First tightening element 23 designed as a threaded bolt has a screw head 26 which acts on respective mounting section 21 of fuel distributor line 5 in such a way that mounting section 21 and supporting socket 25 are clamped between screw head 26 and cylinder head 3 when assembled. Screw head 26 of first tightening element 23 has an extension 27 with a recess 28 in the form of a hexagon, for example, so that a suitable tool for tightening first tightening element 23 can engage in this recess.

Hold-down devices 30 are provided for each fuel injector 4 to guarantee that each fuel injector 4 in a mounting hole 16 is held down with a sufficient hold-down force against the combustion pressure prevailing in combustion chamber 2 of the internal combustion engine. Hold-down devices 30 are composed of a working section 31, which in this embodiment at least partially surrounds and acts on respective fuel injector 4, a guide section 32 provided on mounting device 20 and a connecting section 33 which connects working section 31 to guide section 32. In this embodiment, working section 31 has a collar 34 which can be inserted into a groove 35 on fuel injector 4. Over collar 34, not only can hold-down device 30 exert a hold-down force on fuel injector 4 in the direction of combustion chamber 2 of the engine, but also a force can be transmitted to fuel injector 4 in the opposite direction, so that in dismantling fuel injection system 1, fuel injectors 4 which are connected to fuel distributor line 5 by hold-down device 30 and mounting device 20 can easily be pulled out of respective mounting holes 16. This greatly facilitates dismantling of fuel injection system 1.

Guide section 32 of hold-down devices 30 at least partially surrounds supporting socket 25 and mounting section 21 as well as screw head 26 of first tightening element 23. Therefore, a second tightening element 37, which is designed in the form of a threaded nut in the present embodiment, may act on upper end face 36 of guide section 32. Second tightening element 37 can be screwed onto extension 27 of screw head 26 and can therefore be tightened independently of first tightening element 23 which is designed as a threaded bolt.

Before the actual final assembly, fuel injection system 1 can be preassembled on cylinder head 3 of the internal combustion engine. First, each fuel injector 4 is inserted into a respective hold-down device 30, and an adapter 10 is placed on each fuel injector 4. First tightening elements 23 designed as threaded bolts are inserted into each bore 22 of mounting sections 21 of fuel distributor line 5 and also pass through supporting sockets 25. Finally, guide sections 32 are pushed over supporting sockets 25 and mounting sections 21, with adapters 10 also being inserted into respective receptacles 9 of fuel distributor line 5 at the same time. To prevent guide section 32 from slipping out of socket 25, a nut can be screwed onto the end of first tightening element 23 opposite screw head 26 and can be removed again before final assembly. Fuel injectors 4 are secured on collar 34 of hold-down device 30 to prevent them from slipping out of adapter 10 or out of receptacle 9 of fuel distributor line 5. Fuel injection system 1 preassembled in this way can be pretested for proper functioning, in particular leak tested, at the manufacturing plant of fuel injection system 1 before being shipped to the manufacturer of the internal combustion engine.

At the internal combustion engine manufacturing plant, fuel injection system 1 is then finally assembled in a simple and uncomplicated procedure by screwing first tightening elements 23, which are designed as threaded bolts, into threaded holes 24 in threaded head 3 and tightening by using a tool inserted into recess 28. Second tightening elements 37, which are also preassembled and are designed as threaded nuts, are then tightened by a tool acting on the circumference, for example, so that a sufficient hold-down force acts on fuel injectors 4 by way of hold-down devices 30, with second tightening elements 37 acting on guide sections 32 of the hold-down devices, so that fuel injectors 4 are able to withstand the combustion pressure prevailing in combustion chambers 2 in operation of the internal combustion engine. This extremely simple final assembly can also be performed without any difficulty by a fully automated manufacturing process, thereby greatly reducing manufacturing costs.

Figure 2:
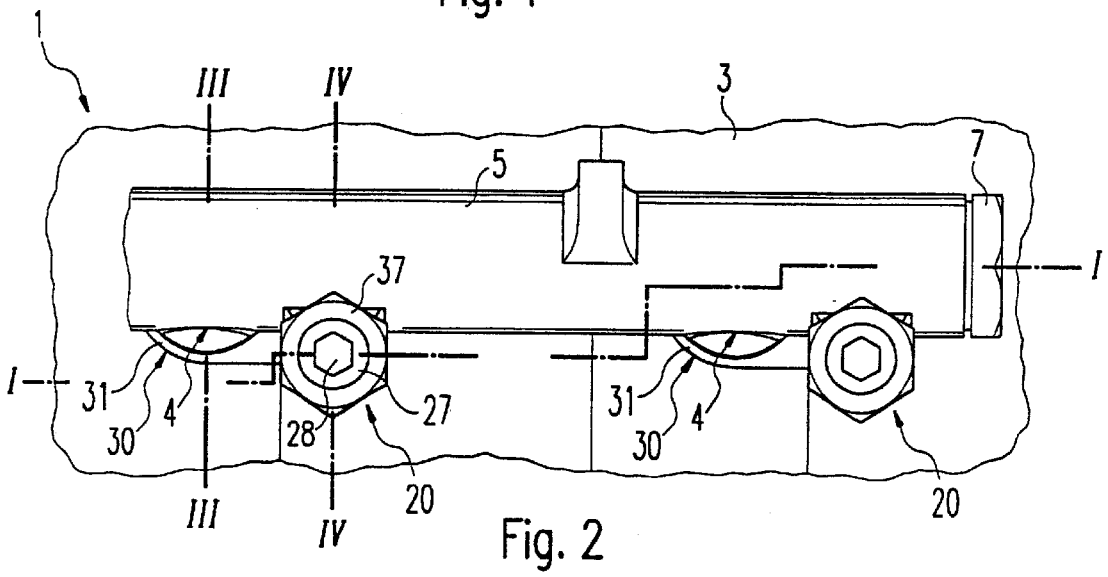
FIG. 2 shows a top view of an embodiment of a fuel injection system according to the present invention as shown in the detail in FIG. 1.
Figure 3:
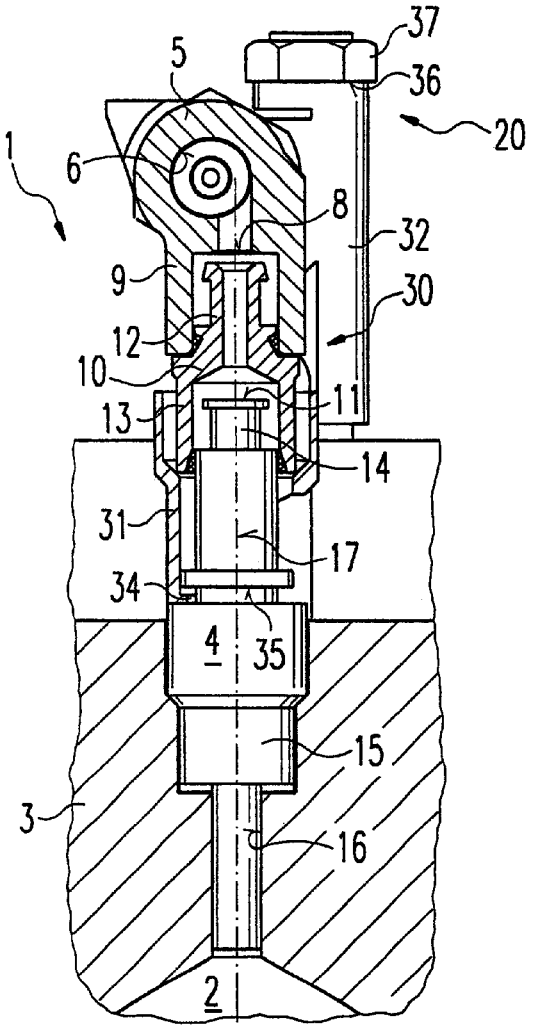
FIG. 3 shows a cross section along line III—III in FIG. 2.
Figure 4:
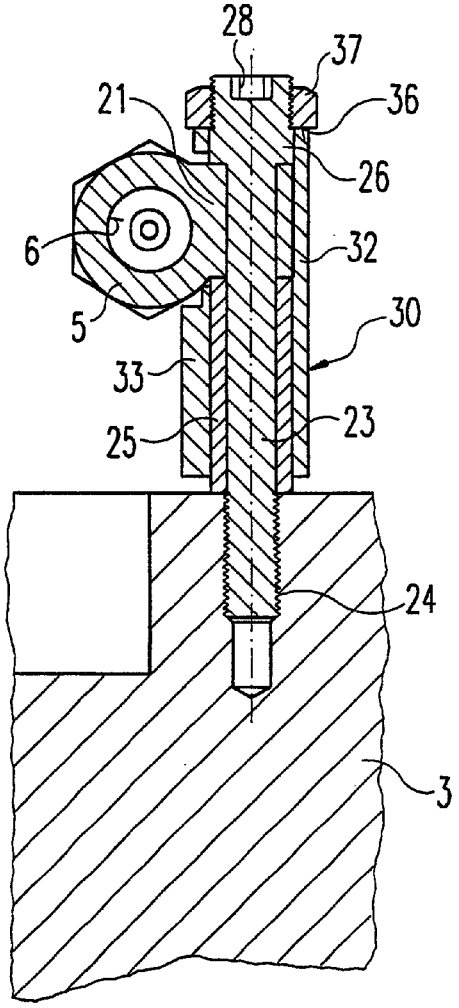
FIG. 4 shows a cross section along line IV—IV in FIG. 2.

To better understand the present invention, FIG. 3 shows a detail of a cross section along line III—III in FIG. 2, and FIG. 4 shows a detail of a cross section along line IV—IV in FIG. 2, where elements that have already been described have been labeled with the same reference numbers.

FIG. 3 clearly shows in particular guide section 32 of hold-down device 30 and second tightening element 37 acting on upper end face 36 of guide section 32 of hold-down device 30. Furthermore, this also shows that mounting device 20 and respective fuel injector 4 are offset relative to one another not only in the longitudinal direction but also in the transverse direction, so that connecting sections 33 of hold-down devices 30 each run diagonally.

FIG. 4 shows cross-sectional views of guide section 32 of hold-down device 30, supporting socket 25, first tightening element 23 and second tightening element 37, illustrating clearly the arrangement of these parts relative to one another in the transverse direction.

What is claimed is:

1. A fuel injection system for a direct injection of a fuel into at least one combustion chamber of an internal combustion engine, comprising:

a spray section;

at least one fuel injector for each one of the at least one combustion chamber and including a fuel inlet orifice, the at least one fuel injector being insertable at the spray section into an allocated mounting hole provided on a cylinder head of the internal combustion engine;

a mounting device assigned to each one of the at least one fuel injector;

a fuel distributor line being attachable to the cylinder head by the mounting device and including for each one of the at least one fuel injector a fuel outlet orifice that is connectable to the fuel inlet orifice of the at least one fuel injector; and a hold-down device allocated to each one of the at least one fuel injector and connected to a respective mounting device, the hold-down device holding down the at least one fuel injector in a respective mounting hole of the cylinder head, wherein each mounting device includes:

a first tightening element for mounting the fuel distributor line on the cylinder head, and a second tightening element for applying a hold-down force to a respective one of the at least one fuel injector.

2. The fuel injection system according to claim 1, further comprising:

a mounting section integrally molded on the fuel distributor line and provided for each mounting device so that the first tightening element can act on the respective mounting section.

3. The fuel injection system according to claim 2, further comprising:

a supporting socket arranged between each mounting section and the cylinder head.

4. The fuel injection system according to claim 3, wherein each hold-down device includes:

a working section that acts on the respective one of the at least one fuel injector, a guide section at least partially surrounding the supporting socket, the respective mounting section of the fuel distributor line, and the first tightening element, and a connecting section connecting the working section to the guide section.

5. The fuel injection system according to claim 4, wherein:

the second tightening element is arranged concentrically with the first tightening element and acts on the guide section of the respective hold-down device.

6. The fuel injection system according to claim 5, wherein:

the first tightening element includes a threaded bolt passing through the respective mounting section of the fuel distributor line and through the respective supporting socket, and the first tightening element is capable of being screwed into a respective threaded hole in the cylinder head.

7. The fuel injection system according to claim 6, wherein:

the second tightening element includes a threaded nut that is capable of being screwed onto a screw head of the first tightening element.

8. The fuel injection system according to claim 7, wherein:

the working section of each hold-down device acts on the respective one of the at least one fuel injector such that a hold-down force acting in a direction of the at least one combustion chamber of the internal combustion engine is capable of acting on the at least one fuel injector and another force in an opposite direction is capable of acting on the at least one fuel injector.

9. The fuel injection system according to claim 8, wherein:

the working section of each hold-down device includes a collar projecting radially inward and capable of being inserted into a groove on the respective one of the at least one fuel injector.

10. The fuel injection system according to claim 1, further comprising:

a tubular adapter arranged between each fuel outlet orifice of the fuel distributor line and the fuel inlet orifice of the respective one of the at least one fuel injector.

* * * * *